US011525652B2

(12) United States Patent
Chen et al.

(10) Patent No.: US 11,525,652 B2
(45) Date of Patent: Dec. 13, 2022

(54) PREPARATION METHOD OF UNIFORM LOW STRESS CONE SHAPED CHARGE LINER

(71) Applicant: No.59 Research Institute of China Ordnance Industry, Chongqing (CN)

(72) Inventors: Qiang Chen, Chongqing (CN); Dayu Shu, Chongqing (CN); Qiang Zhao, Chongqing (CN); Feng Kang, Chongqing (CN); Shuhai Huang, Chongqing (CN); Wei Zhang, Chongqing (CN); Zude Zhao, Chongqing (CN); Xiangsheng Xia, Chongqing (CN)

(73) Assignee: No.59 Research Institute of China Ordnance Industry, Chongqing (CN)

( * ) Notice: Subject to any disclaimer, the term of this patent is extended or adjusted under 35 U.S.C. 154(b) by 1043 days.

(21) Appl. No.: 16/209,999

(22) Filed: Dec. 5, 2018

(65) Prior Publication Data

US 2019/0170486 A1 Jun. 6, 2019

(30) Foreign Application Priority Data

Dec. 6, 2017 (CN) ..... 201711280825.3

(51) Int. Cl.
*F42B 1/036* (2006.01)
*B21C 23/00* (2006.01)
(Continued)

(52) U.S. Cl.
CPC ..... *F42B 1/036* (2013.01); *B21C 23/14* (2013.01); *B21K 21/06* (2013.01); *C21D 9/0068* (2013.01);
(Continued)

(58) Field of Classification Search
CPC ..... F42B 1/036
See application file for complete search history.

(56) References Cited

U.S. PATENT DOCUMENTS 4,001,053 A * 1/1977 Igisu ..... C21D 10/00 148/558
2011/0302979 A1* 12/2011 Oppenheimer ..... B21C 23/32 72/42

FOREIGN PATENT DOCUMENTS

CN 104789911 A * 7/2015 ..... C22F 1/08
CN 105562448 A * 5/2016 ..... B21C 23/001

OTHER PUBLICATIONS

Machine translation of CN-104789911-A (Year: 2015).*
Machine translation of CN-105562448-A (Year: 2016).*

* cited by examiner

*Primary Examiner* — Moshe Wilensky
*Assistant Examiner* — Kyle A Cook
(74) *Attorney, Agent, or Firm* — Bayramoglu Law Offices LLC

(57) ABSTRACT

A preparation method of a uniform low stress cone shaped charge liner includes the steps of multi-pass extrusion forming, vibration aging treatment, and cryogenic treatment. The step of multi-pass extrusion forming refers to 4 to 8 passes of extrusion deformation under the actions of a three-dimensional compressive stress and a deformation rate of 5 to 10 mm/s, having a deformation amount of 5 to 50% for each pass. The shaped charge liner prepared by the present invention has high dimensional accuracy, good geometric symmetry, low stress value, and excellent stability in the precise machining process and in use, which may significantly improve the penetration capability and stability of the shaped charge liner of high-explosive anti-tank warheads.

1 Claim, 2 Drawing Sheets
(2 of 2 Drawing Sheet(s) Filed in Color)

(51) Int. Cl.

| | |
|---|---|
| ***B21C 23/14*** | (2006.01) |
| ***F42B 1/028*** | (2006.01) |
| ***F42B 1/032*** | (2006.01) |
| ***B21K 21/06*** | (2006.01) |
| ***C21D 9/00*** | (2006.01) |
| ***C22F 1/00*** | (2006.01) |
| ***C22F 1/08*** | (2006.01) |
| *F42B 33/02* | (2006.01) |

(52) U.S. Cl.

CPC ..... *C22F 1/002* (2013.01); *C22F 1/08* (2013.01); *F42B 1/028* (2013.01); *F42B 1/032* (2013.01); *B21C 23/001* (2013.01); *F42B 33/0257* (2013.01); *F42B 33/0271* (2013.01)

PREPARATION METHOD OF UNIFORM LOW STRESS CONE SHAPED CHARGE LINER

CROSS REFERENCE TO RELATED APPLICATIONS

This application is based upon and claims priority to Chinese Patent Application No. 201711280825.3, filed on Dec. 6, 2017, the entire contents of which are incorporated herein by reference.

TECHNICAL FIELD

The present invention relates to the technical field of metal plastic forming, particularly to a preparation method of a uniform low stress cone-shaped charge liner.

BACKGROUND

The typical shaped charge jet has a relatively high head velocity (greater than or equal to 8500 m/s) and a low tail velocity (about 3000 m/s), so this kind of velocity gradient allows the jet to be pulled long (reaching 20 to 100 times apertures of the shaped charge liner) under the condition of a certain bursting height, having high penetration capability. The penetration capability of the jet is proportional to the length of the continuous jet. However, due to the internal defects of the metal and the expansion of the jet, the jet may eventually break into several segments of particles in the axial direction, thus limiting the length of the continuous jet and the transmission of the penetration capability. Moreover, the broken particles are disturbed by each other, causing the penetration capability thereof dropping sharply.

Ninety-eight percent of the existing high-explosive anti-tank warheads use copper shaped charge liners, the forming process thereof mainly includes electroforming, spinning, stamping, cold extrusion, and warm extrusion. Furthermore, the shaped charge liners formed by electroforming and cold extrusion are the priority of development. Foreign research institutions have done extensive and in-depth research on the relationship among the internal structure (grain size, morphology, grain boundary, etc.), manufacturing process and high-explosive anti-tank performance of copper shaped charge liners. Research shows that parameters of shaped charge liner products such as dimensional accuracy, surface quality, and intrinsic stress state, grain size, and grain boundary morphology have significant effects on the penetration capability. The dimensional accuracy, intrinsic stress and its distribution are key factors that affect the penetration stability. In the design and acceptance standard of the shaped charge liner product, requirements of "high dimensional accuracy, high geometric symmetry, high smoothness, and uniform distribution of low stress values" are proposed.

With the development of a new generation of reactive armor, ceramic armor, and composite armor, higher requirements are raised on the damage power and stability of the shaped charge liner, and preparing high-quality shaped charge liners has become one of the key technologies for developing high-performance warheads. Under the same conditions of the charge, the bursting height, and the structure and material of the shaped charge liner, the penetration run-out error of the foreign shaped charge liner is no more than 8%, while the penetration run-out error of the domestic ones reaches more than 30%. Through the analysis of reverse engineering and modern material analysis method, the research shows that the average stress value of foreign pure copper shaped charge liner formed by cold extrusion is 10 to 30 MPa, and the deviation value of the taper angle thereof is less than or equal to 2', while the stress value at the top of the cone-shaped charge liner for domestic one reaches 120 to 200 MPa, and the stress distribution is uneven, all of which seriously affect the stability of product quality. Therefore, this application provides a preparation method of a uniform low stress cone-shaped charge liner.

SUMMARY

The technical problem to be solved by the present invention is to provide a preparation method of a uniform low stress cone-shaped charge liner, including multi-pass extrusion forming, vibration aging, cryogenic treatment and the following recrystallization heat treatment process. The prepared shaped charge liner has high dimensional accuracy, good geometric symmetry, low stress value, and excellent stability in the precise machining process and the final use, which may significantly improve the penetration capability and stability of the shaped charge liner for high-explosive anti-tank warheads.

A preparation method of a uniform low stress cone-shaped charge liner includes the steps of multi-pass extrusion forming, vibration aging treatment, and cryogenic treatment. The step of multi-pass extrusion forming refers to 4 to 8 passes of extrusion deformation under the actions of a three-dimensional compressive stress and a deformation rate of 5 to 10 mm/s, having a deformation amount of 5 to 50% for each pass.

Preferably, in the multi-pass extrusion forming, the surface of the billet and the inner surface of the mold cavity are coated with lubricants.

The difference of circumferential wall thickness of the cone-shaped charge liner formed by multi-pass extrusion forming is less than or equal to 0.1 mm.

The above-mentioned vibration aging treatment is performed 1 to 3 times, the time of the vibration aging treatment for each time is 20 min to 60 min.

In the above-mentioned cryogenic treatment, cryogenic medium is liquid nitrogen, cooling temperature is −135° C. to −145° C., and the number of cooling times is 2 to 4, with 15 min to 45 min for each time.

In the present invention, the cone-shaped charge liner is formed and surface quality thereof is controlled, the stress gradient of different parts of the cone-shaped charge liner is eliminated and homogenized, and the stress of the shaped charge liner with fine shape is released and uniformed, which ensure the dimensional accuracy and surface quality of the shaped charge liner, and at the same time, obtain a uniform low stress value.

The present invention is realized by the following technical solutions.

A preparation method of a uniform low stress cone-shaped charge liner includes the following process steps:

(1) preparation of billet: according to the shape and structure of the designed cone copper shaped charge liner, calculating the volume of the raw material; according to plastic forming theory, near-uniform plastic deformation principle, and numerical simulation analysis, selecting the proper size of the billet; cutting the copper rod into a corresponding length according to volume constant principle of part; the diameter of the copper rod is ϕ20 to 170 mm, and the copper material may choose TU1, TU2, T2, T3, etc.

(2) homogenizing heat treatment: annealing the billet obtained in step (1) in a vacuum heat treatment furnace at a temperature of 380° C. to 550° C. for 1 to 3 h, and then cooling to a temperature below 100° C. with the furnace having the vacuum degree of less than or equal to $3\times10^{-3}$ Pa, to obtain a uniform structure, reduce the processing hardness of the raw material, and improve the plastic formability of the raw material.

(3) multi-pass extrusion forming: placing the billet obtained in step (2) in the mold cavity of the extrusion die, under the actions of the three-dimensional compressive stress and the deformation rate of 5 mm/s to 10 mm/s, performing 4 to 8 passes of the extrusion deformation, and the deformation amount for each pass is between 5% and 50%; during the forming process, the surface of the billet and the inner surface of the mold cavity are respectively coated with a layer of lubricant, so that the difference of circumferential wall thickness of the cone-shaped charge liner formed by multi-pass extrusion forming is less than or equal to 0.1 mm, thereby a cone-shaped charge liner of a desired shape and size is obtained.

(4) vibration aging treatment: subjecting the shaped charge liner obtained in step (3) to vibration aging treatment for 1 to 3 times, the IFVSR-2000 type intelligent vibration aging device is used. Formant is automatically selected by the device through sweeping frequency, and the process can be controlled by the acceleration amplitude during the vibration aging treatment. The time of the vibration aging treatment is 20 min to 60 min.

(5) recrystallization heat treatment: placing the cone-shaped charge liner obtained in step (4) in a vacuum heat treatment furnace, and keeping the temperature at 150° C. to 350° C. for 45 min to 75 min, then the recrystallization annealing treating the cone-shaped charge liner to perform the grain boundary optimization, and the dislocation slip and dislocation climbing, causing the change of the local lattice and the interface orientation of grain boundary, promoting the formation of dynamic recrystallization and twinning during annealing treating, and reducing the work hardening effect. The average grain size of the cone-shaped charge liner is less than or equal to 10 μm.

(6) fine shaping: placing the component obtained in step (5) in the mold cavity of the extrusion die, under the actions of three-dimensional compressive stress and deformation rate of 5 mm/s to 10 mm/s, performing 1 to 4 passes of fine shaping, and the deformation amount for each pass is less than or equal to 2%, so that the difference of circumferential wall thickness of the cone-shaped charge liner is less than or equal to 0.1 mm, and the surface roughness is Ra 0.2 μm.

(7) cryogenic treatment: placing the component obtained in step (6) in a cryogenic treatment device, the cryogenic medium is liquid nitrogen (−196° C.), the cooling temperature is from −135° C. to −145° C., and the number of the cooling times is 2 to 4, with 15 min to 45 min for each time.

In the 4 to 8 passes of the extrusion deformation in step (3), according to the aperture size of the cone-shaped charge liner, the inner cone angle, the wall thickness and other shape and structure characteristics, the required deformation passes and other processes may be designed. The number of the deformation passes of the part with small size and simple shape is low. In the shaped charge liners having the same aperture size, the number of deformation passes of the shaped charge liner having a single taper angle are less than that of the deformation passes of the shaped charge liner having a double taper angle.

In step (3), the deformation amount is 5% to 50%; according to the deformation passes and the structure of the component, the deformation amount for each pass is reasonably arranged, the deformation amount decreases with the increase of the deformation passes, so the plastic forming of the shaped charge liner is controlled by the gradient deformation amount.

In step (3), the lubricant includes common lubricants such as tea oil, fine billeting oil, castor oil, rapeseed oil, etc., or a combination thereof. In each pass of forming process, the lubricant is coated on the surfaces of the billet and the mold cavity to reduce the friction between the billet and the contact surface of the mold, enhance the fluidity of the metal during the forming process, and improve the surface quality of the formed component.

In the 1 to 3 times of vibration aging treatment in step (4), the applying times is determined by parameters such as the depth of the inner hole, the wall thickness of the opening and bottom of the shaped charge liner, and the vibration aging treatment is added in the 4 to 8 passes of extrusion deformation process.

In the 1 to 4 passes of fine shaping in step (6), the times of fine shaping is determined according to parameters such as the shape and aperture of the shaped charge liner.

In the 2 to 4 times of cryogenic treatment in step (7), the times of cooling are determined according to parameters such as the weight and wall thickness of a single shaped charge liner.

Beneficial Effects:

In the present invention, according to the processing steps of large deformation control technology, vibration aging treatment and cryogenic treatment, and the parameter adjustment, the cone-shaped charge liner is finally formed and surface quality thereof is well controlled, the stress gradient of different parts of the cone-shaped charge liner is eliminated and homogenized, and the stress of the shaped charge liner with fine shape is released and uniformed, which ensure the dimensional accuracy and surface quality of the shaped charge liner, and at the same time, obtain a uniform low stress value. Through this method, a uniform and fine equiaxial structure is obtained with low and uniform stress values in different parts, which provides a new preparation method for the development of high-performance fine-grained copper cone-shaped charge liner.

The present invention overcomes the technical problems such as poor surface quality, large difference of internal grain size and uneven stress distribution existing in the components obtained by conventional preparation method. At the same time, the present invention has the advantages of high production efficiency, good process stability and easy realization of industrial production, etc.

(1) The dimensional uniformity of products is good. After the processes of multi-pass extrusion forming, vibration aging treatment, recrystallization heat treatment, and cryogenic treatment, the stress values of different parts of the product reach the level of electroformed shaped charge liner, the average stress value is less than or equal to 30 MPa, and the deviation value of the taper angle is less than or equal to 2'.

(2) The material utilization of products is high. A mechanical machining allowance of 0.7 mm to 1.2 mm is left on the outer surface of the cone-shaped charge liner produced by the multi-pass extrusion forming method, and the inner surface is completely unprocessed, which may significantly improve the material utilization of the cone-shaped charge liner.

(3) The performance of products is good. The cone-shaped charge liner produced by the multi-pass extrusion forming method has the metal fibers distributed along the contour shape of the component, and the metal fibers are continuous and dense; after the vibration aging treatment, recrystallization heat treatment, and cryogenic treatment, an equiaxed fine grain structure in a low stress state is obtained; at the same time, the inner surface of the cone-shaped charge liner is not processed, which overcomes the technical problems of the bad effects of machining cutter marks on plastic fluidity and ductility of the shaped charge jet under high temperature and high pressure.

(4) The product quality is effectively controlled. Through the strict specification control of process parameters such as deformation pass, deformation amount, temperature and time, the required microstructure is obtained, the effectiveness control of the product quality of the components is realized, and the stability and uniformity of the products are improved.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION OF THE EMBODIMENTS

The present invention is further described below with reference to the specific embodiments.

Embodiment 1

(1) Preparation of billet: taking a shaped charge liner having a shape of a double cone structure and a tapered wall thickness as an example, the shaped charge liner has an aperture of ϕ185 mm, a height of 170 mm, an inner cone depth of 162 mm, a wall thickness of 4.0 mm to 5.5 mm, a small cone angle of 30°, a large cone angle of 60°, and a transition arc R between the large and small cone angle of 152 mm; according to plastic forming theory and near-uniform plastic deformation principle, a machining allowance of 1 mm is left on the outer surface of the shaped charge liner, and a forming process boss of ϕ20 mm is designed on the top of the cone-shaped charge liner; the forming process is simulated and optimized by UG and DEFORM software, and the volume of the billet is calculated. The extruded T2 copper rod of ϕ90 mm is selected as the raw material, and the outer surface of the rod was cut to make a billet having a diameter of 88 mm and a height of 55 mm; the content of the impurity element of the T2 red copper rod is as shown in Table 1:

TABLE 1

Content of impurity element of T2 copper rod

| Brand | Bi | Sb | As | Fe | Ni | Sn | S | O | Zn | Total |
|---|---|---|---|---|---|---|---|---|---|---|
| T2 | 0.001 | 0.002 | 0.002 | 0.005 | 0.002 | 0.002 | 0.004 | 0.005 | 0.004 | 0.1 |

Figure 1:
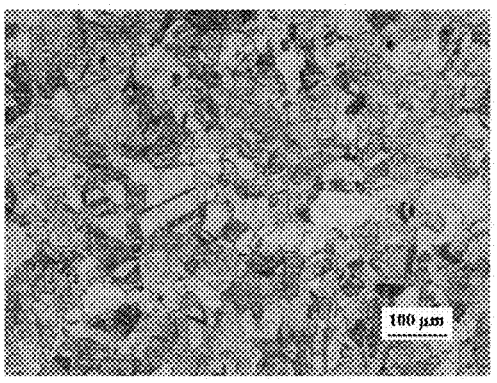
FIG. 1 is a diagram showing a grain structure of a red copper billet (metallographic microscope is magnified 100 times, and average grain size is about 130 μm)

(2) Homogenizing heat treatment: the billet obtained in step (1) is kept in a VQG-2500 intelligent temperature-controlled vacuum heat treatment furnace at 480±1° C. for 1 h, and the degree of vacuum is $1.5\times10^{-3}$ Pa. After the heat treatment, the billet experiences furnace cooling until 80° C. to obtain a billet with uniform composition and structure. The hardness is from HB35 to HB38, and the grain size of copper is about 130 μm, as shown in FIG. 1.

Figure 2:
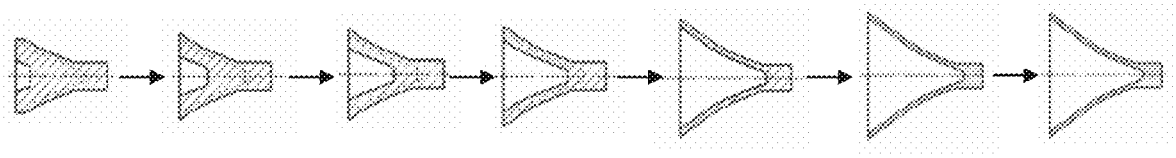
FIG. 2 is a diagram showing a multi-pass extrusion forming process of a double cone-shaped charge liner.

(3) Multi-pass extrusion forming: the billet obtained in step (2) is placed in the mold cavity of the extrusion die, under the actions of the three-dimensional compressive stress and a certain deformation rate, 7 passes of the extrusion deformation are performed to obtain the cone-shaped charge liner, and its forming process is shown in FIG. 2, the deformation amount arrangement for each pass is shown in Table 2. The multi-pass extrusion die includes die system, punch system, and ejection system, the multi-pass extrusion forming equipment is 1600 t hydraulic press, and deformation rate of the hydraulic machine is 5 mm/s to 10 mm/s, the die system of the extrusion die is installed on the work surface of the hydraulic press, the ejection system is connected with the ejector mechanism of the hydraulic press, the punch system is connected with the working slider of the hydraulic press, and the extrusion punch is driven by the working slider of the hydraulic press to perform extrusion. The extrusion punch cooperates with the extrusion concave die to make the billet in a three-dimensional stress state. The first pass is a large deformation cogging process to obtain a cone billet; the subsequent 2 to 6 passes are reaming extrusion (the deformation amount is less than 40%), so that the wall thickness of the shaped charge liner is gradually thinned. As the extrusion pass increases, the work hardening effect is enhanced, and the deformation amount gradually decreases; the last pass is the final shaping, which improves the dimensional accuracy and dimensional stability of the formed component, and the deformation amount is generally less than 10%. After the multi-pass extrusion forming, a shaped charge liner having the required shape, size, surface quality, and a certain mechanical property is obtained.

TABLE 2

Process parameters of the extrusion deformation

| Deformation Pass | Deformation Amount Arrangement | Deformation Rate | Deformation Temperature | Lubricant |
|---|---|---|---|---|
| 1 | 48% | 8 mm/s | 25-30° C. | Tea oil |
| 2 | 38% | | | |
| 3 | 31% | | | |
| 4 | 25% | | | |
| 5 | 20% | | | |
| 6 | 16% | | | |
| 7 | 6% | | | |

Figure 3:
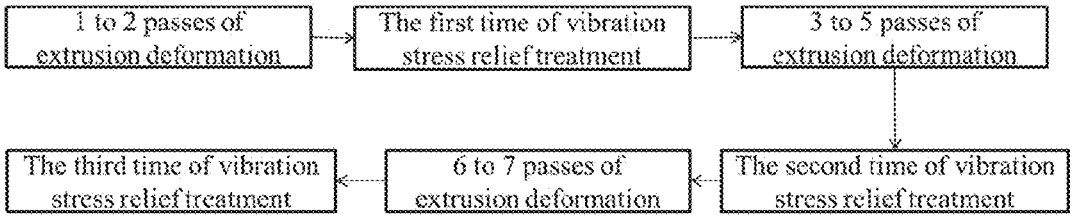
FIG. 3 is a diagram showing a vibration aging treatment.

(4) Vibration aging treatment: the IFVSR-2000 type device is used, and the formant is automatically selected by the device through sweeping frequency, which can be controlled by the acceleration amplitude during the treatment, 3 times of vibration aging treatment are set in step (3), as shown in FIG. 3. The first vibration aging treatment is performed after the second deformation pass, and the vibration time is 25 min; the second vibration aging treatment is performed after the fifth deformation pass, and the vibration time is 35 min; and the third vibration aging treatment is performed after the seventh deformation pass, and the vibration time is 45 min.

Figure 4:
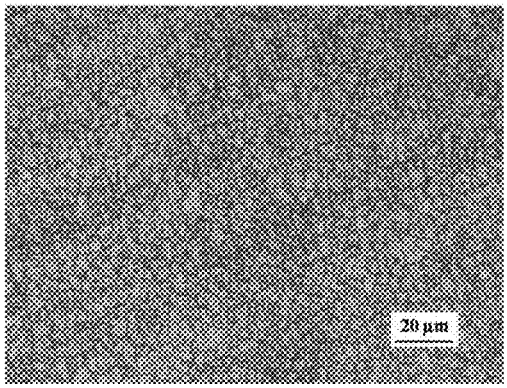
FIG. 4 is a diagram showing a microstructure of a cone-shaped charge liner after a fine shaping (metallographic microscope is magnified 500 times, and average grain size is about 10 μm)
Figure 5:
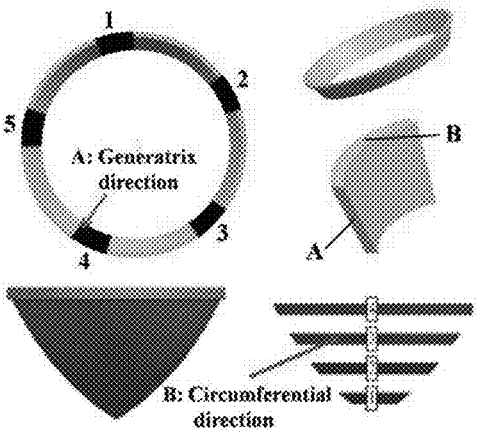
FIG. 5 is a diagram of a stress test of different parts of a shaped charge liner.

(5) Recrystallization heat treatment: the cone-shaped charge liner obtained in step (4) is placed in a vacuum heat treatment furnace, and is kept at 320° C. for 60 min, then the grain boundary optimization, and the dislocation slip and dislocation climbing are performed by recrystallization annealing treatment, causing the change of the local lattice and the interface orientation of grain boundary, promoting the formation of dynamic recrystallization and twinning during annealing, and reducing the work hardening effect. The average grain size of the cone-shaped charge liner is 10 μm, as shown in FIG. 4.

(6) Fine shaping: the component obtained in step (5) is placed in the mold cavity of the extrusion die, under the actions of three-dimensional compressive stress and deformation rate of 5 mm/s, 2 passes of fine shaping are performed, and the deformation amount for each pass is about 1%, the difference of circumferential wall thickness of the cone-shaped charge liner is 0.04 mm to 0.07 mm, and the surface roughness is Ra 0.12 μm to Ra 0.2 μm, and the deviation value of the taper angle is less than or equal to 2'.

(7) Cryogenic treatment: the component obtained in step (6) is placed in a cryogenic treatment device, the cryogenic medium is liquid nitrogen (−196° C.), the cooling temperature is −135° C. to −145° C., and the number of the cooling times is 2, with 30 min for each time, and the time interval between the two times of cryogenic treatment is 1 h.

The stress value of the above-mentioned shaped charge liner is tested by using the X-ray stress test method, the obtained stress values are shown in Table 3. The average stress value along the circumferential direction, and the direction of generatrix is from 19 MPa to 22 MPa.

TABLE 3

Stress values of different parts of shaped charge liner

| Test part | 1 | 2 | 3 | 4 | 5 | Average value |
|---|---|---|---|---|---|---|
| 1-small cone | 23.9 | 20.1 | 21.5 | 22.8 | 24.3 | 22.52 |
| 2-circular arc | 22.3 | 19.4 | 20.4 | 17.3 | 19.4 | 19.76 |
| 3-big cone | 16.5 | 18.3 | 20.7 | 19.6 | 20.1 | 19.04 |
| 4-opening | 23.2 | 19.7 | 18.3 | 20.2 | 18.6 | 20.00 |
| Average value | 21.475 | 19.375 | 20.225 | 19.975 | 20.6 | |

Embodiment 2

(1) Preparation of billet: taking a shaped charge liner having an inner shape of single cone structure and an equal wall thickness as an example, the shaped charge liner has an aperture of ϕ160 mm, a height of 152 mm, an inner cone depth of 138 mm, a wall thickness of 4.2 mm, and an inner taper angle of 60°; according to plastic forming theory and near-uniform plastic deformation principle, a machining allowance of 0.8 mm is left on the outer surface of the shaped charge liner formed by multi-pass extrusion forming, and a forming process boss of ϕ15 mm is designed on the top of the shaped charge liner; the forming process is simulated and optimized by UG and DEFORM software, and the volume of the billet is calculated. The stretched T2 copper rod of ϕ50 mm is selected as the raw material, and the outer surface of the rod was cut to make a billet having a diameter of 49 mm and a height of 80 mm.

(2) Homogenizing heat treatment: the billet obtained in step (1) is kept in a VQG-2500 intelligent temperature-controlled vacuum heat treatment furnace at 420±1° C. for 1 h, and the degree of vacuum is $1.5\times10^{-3}$ Pa. After the heat treatment, the billet experiences furnace cooling until 80° C. to obtain a billet having uniform composition and structure. The hardness is from HB32 to HB35, and the grain size of the copper is about 70 μm.

(3) Multi-pass extrusion forming: the billet obtained in step (2) is placed in the mold cavity of the extrusion die, under the actions of the three-dimensional compressive stress and a certain deformation rate, 6 passes of the extrusion deformation are performed, and the deformation amount arrangement for each pass is shown in Table 4. The multi-pass extrusion die includes die system, punch system, and ejection system, the multi-pass extrusion equipment is 1600 t hydraulic press, and deformation rate of the hydraulic machine is 5 mm/s to 10 mm/s, the die system of the extrusion die is installed on the work surface of the hydraulic press, the ejection system is connected with the ejector mechanism of the hydraulic press, the punch system is connected with the working slider of the hydraulic press, and the extrusion punch is driven by the working slider of the hydraulic press to perform extrusion. The extrusion punch cooperates with the extrusion concave die to make the billet in a three-dimensional stress state. The first pass is a large deformation cogging to obtain a cone billet; the subsequent 2 to 5 passes are reaming extrusion (the deformation amount is less than 40%), so that the wall thickness of the shaped charge liner is gradually thinned. As the extrusion pass increases, the work hardening effect is enhanced, and the deformation amount gradually decreases; the last pass is the final shaping, which improves the dimensional accuracy and dimensional stability of the formed component, and the deformation amount is generally less than 10%. After the multi-pass extrusion forming, a shaped charge liner having the required shape, size, surface quality, and a certain mechanical property is obtained.

TABLE 4

Parameters of deformation pass

| Deformation Pass | Deformation Amount Arrangement | Deformation Rate | Deformation Temperature | Lubricant |
|---|---|---|---|---|
| 1 | 42% | 6 mm/s | 25-30° C. | Rapeseed oil |
| 2 | 30% | | | |
| 3 | 25% | | | |
| 4 | 22% | | | |
| 5 | 15% | | | |
| 6 | 8% | | | |

(4) Vibration aging treatment: the IFVSR-2000 type device is used, and the formant is automatically selected by the device through sweeping frequency, which can be controlled by the acceleration amplitude during the treatment, 2 times of vibration aging treatment are set in step (3). The first vibration aging treatment is performed after the third deformation pass with the vibration time of 30 min; and the second vibration aging treatment is performed after the sixth deformation pass with the vibration time of 45 min.

(5) Recrystallization heat treatment: the cone-shaped charge liner obtained in step (4) is placed in a vacuum heat treatment furnace, and kept at 250° C. for 60 min, then the grain boundary optimization, the dislocation slip and dislocation climbing are performed by recrystallization annealing treatment, causing the change of local lattice and the interface orientation of grain boundary, promoting the formation of dynamic recrystallization and twinning during annealing, and reducing the work hardening effect. The average grain size of the cone-shaped charge liner is 5 μm.

(6) Fine shaping: the component obtained in step (5) is placed in the mold cavity of the extrusion die, under the actions of three-dimensional compressive stress and deformation rate of 5 mm/s, 1 pass of fine shaping are performed, and the deformation amount is about 1.5%, the difference of circumferential wall thickness of the cone-shaped charge liner is 0.03 mm to 0.05 mm, and the surface roughness is Ra 0.08 μm to Ra 0.16 μm, and the deviation value of the taper angle is less than or equal to 2'.

(7) Cryogenic treatment: the component obtained in step (6) is placed in a cryogenic treatment device, the cryogenic medium is liquid nitrogen (−196° C.), the cooling temperature is −135° C. to −145° C., and the number of the cooling times is 5 with 1 h for each time, and the time interval between each two times of cryogenic treatment is 1 h.

The stress value of the above-mentioned shaped charge liner is tested by using the X-ray stress test method, the obtained stress values are shown in Table 5. The average stress value along the circumferential direction and the direction of generatrix is between 18 MPa to 22 MPa.

TABLE 5

Stress values of different parts of shaped charge liner

| Test part | 1 | 2 | 3 | 4 | 5 | Average value |
|---|---|---|---|---|---|---|
| 1-small cone | 20.6 | 21.3 | 20.9 | 22.8 | 22.7 | 21.66 |
| 2-circular arc | 19.5 | 19.6 | 18.8 | 18.9 | 17.2 | 18.80 |
| 3-big cone | 18.3 | 18.9 | 17.4 | 19.7 | 18.1 | 18.48 |
| 4-opening | 21.1 | 20.4 | 19.3 | 18.3 | 16.5 | 19.12 |
| Average value | 19.875 | 20.05 | 19.10 | 19.925 | 18.625 | |

The results show that the low stress, uniform and fine equiaxed crystal structure shaped charge liner obtained by this method has an average grain size of less than or equal to 10 μm, the average stress value in the circumferential direction and the direction of generatrix thereof is about 22 MPa, the difference of circumferential wall thickness of the shaped charge liner is less than or equal to 0.07 mm, the surface roughness reaches Ra 0.2 μm, and the deviation value of the taper angle is less than or equal to 2'.

What is claimed is:

1. A method of preparing a cone-shaped charge liner having a uniform distribution of stress, the method comprising:

a first step of preparing a copper rod to obtain a billet;

a second step of annealing the billet in a vacuum heat treatment furnace at a temperature of 380° C. to 550° C. for 1 hour to 3 hours, and then the billet being cooled to below 100° C. with the vacuum heat treatment furnace to obtain a heat-treated billet, a vacuum degree of the vacuum heat treatment furnace is less than or equal to $3\times10^{-3}$ Pa;

a third step of performing a multi-pass extrusion on the heat-treated billet, the multi-pass extrusion comprising 4 to 8 passes of an extrusion deformation under a three-dimensional compressive stress and a deformation rate of 5 mm/s to 10 mm/s for each extrusion deformation, wherein a deformation amount of the heat-treated billet for each pass of the extrusion deformation is 5% to 50%, wherein the heat-treated billet is placed in a mold cavity of an extrusion die during the multi-passes extrusion to obtain an extruded cone-shaped charge liner, wherein a difference of a circumferential wall thickness of the extruded cone-shaped charge liner is less than or equal to 0.1 mm, and wherein during the multi-pass extrusion a surface of the heat-treated billet and an inner surface of the mold cavity are respectively coated with a lubricant;

a fourth step of subjecting the extruded cone-shaped charge liner to a vibration aging treatment for 1 to 3 times to obtain an aged cone-shaped charge liner, wherein each vibration aging treatment occurs between the 4 to 8 passes of the extrusion deformation or after the third step is completed, and wherein a processing time of each of the vibration aging treatments is 20 min to 60 min;

a fifth step of performing a heat treatment on the aged cone-shaped charge liner by placing the aged cone-shaped charge liner in the vacuum heat treatment furnace, and keeping the aged cone-shaped charge liner at 150° C. to 350° C. for 45 min to 75 min to obtain a heat-treated cone-shaped charge liner;

a sixth step of placing the heat-treated cone-shaped charge liner in the mold cavity of the extrusion die and performing a fine shaping to obtain a fine-shaped cone-shaped charge liner, the fine shaping comprising 1 to 4 passes of fine-shaped extrusion deformation under the three-dimensional compressive stress and the deformation rate of 5 mm/s to 10 mm/s for each fine-shaped extrusion deformation, wherein a deformation amount of the fine-shaped cone-shaped charge liner for each pass of the fine-shaped extrusion deformation is less than or equal to 2%, wherein a difference of a circumferential wall thickness of the fine-shaped cone-shaped charge liner is less than or equal to 0.1 mm, and wherein a surface roughness of the fine-shaped cone-shaped charge liner is Ra 0.2 μm; and a seventh step of performing a cryogenic treatment to the fine-shaped cone-shaped charge liner by placing the fine-shaped cone-shaped charge liner in a cryogenic treatment device to obtain the cone-shaped charge liner having the uniform distribution of stress, wherein the cryogenic treatment uses a cryogenic medium comprising liquid nitrogen, is performed at a cooling temperature of −135° C. to −145° C., and comprises a cooling time of 15 min to 45 min, and wherein the cryogenic treatment is performed 2 to 4 times.

* * * * *